US006644307B2

(12) United States Patent
Morgan et al.

(10) Patent No.: US 6,644,307 B2
(45) Date of Patent: Nov. 11, 2003

(54) SCUBA DIVING BUBBLE DIVERTER FOR IMPROVING VISION AND DECREASING BUBBLE NOISE

(75) Inventors: William B. Morgan, Santa Barbara, CA (US); Connie L. Morgan, Santa Barbara, CA (US); Trent M. Schultz, Goleta, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 0 days.

(21) Appl. No.: 10/085,189

(22) Filed: Feb. 26, 2002

(65) Prior Publication Data

US 2003/0159692 A1 Aug. 28, 2003

(51) Int. Cl.[7] ..... B63C 11/02

(52) U.S. Cl. ..... 128/200.29; 128/201.27; 128/201.22; 128/206.21

(58) Field of Search ..... 128/200.27, 200.29, 128/201.27, 201.23, 201.22, 205.25, 205.22, 206.28, 206.21, 207.14, 204.18, 201.15

(56) References Cited

U.S. PATENT DOCUMENTS

| | | | | | |
|---|---|---|---|---|---|
| 4,527,657 | A | * | 7/1985 | Payne | 181/18 |
| 4,838,256 | A | * | 6/1989 | Miltz | 128/202.27 |
| 4,856,120 | A | | 8/1989 | Hart | 2/428 |
| 5,329,643 | A | | 7/1994 | Sato | 2/428 |
| 5,575,277 | A | | 11/1996 | Lutz et al. | 128/201.18 |
| 5,860,168 | A | * | 1/1999 | Winefordner et al. | 2/428 |

* cited by examiner

*Primary Examiner*—Glenn K. Dawson
*Assistant Examiner*—Mark Rademacher
(74) *Attorney, Agent, or Firm*—Cislo & Thomas LLP

(57) ABSTRACT

A scuba diving bubble diverter adapted for use by a diver wearing a diving mask and air regulator and employing a skirt system for diverting bubbles emanating from the breathing regulator away from the diver's head.

13 Claims, 9 Drawing Sheets

SCUBA DIVING BUBBLE DIVERTER FOR IMPROVING VISION AND DECREASING BUBBLE NOISE

BACKGROUND OF THE INVENTION

1. Field of the Invention

This invention generally relates to Self Contained Underwater Breathing Apparatus (SCUBA) diving equipment and more particularly to Scuba equipment for affecting bubble dispersion and noise diversion for the user of the Scuba equipment.

2. Description of the Related Art

Typical Scuba diving equipment comprises a diving mask generally covering the diver's nose and eyes, and a breathing regulator which includes a mouthpiece connected to an air tank. The mask generally has a soft seal that conforms against the diver's face to create an air space in front of the eyes and nose, a substantially transparent window mounted within the frame in front of the diver's eyes, and an adjustable strap assembly to hold the mask to the diver's head.

Divers may also use equipment for underwater communication. Electronic underwater communication systems typically have a microphone/earphone assembly and a signal sending/receiving unit or hard wires for communication to the surface and/or other divers. Non-electronic communications systems may generally consist of an air chamber assembly that is held in front of the mouth having a diaphragm that vibrates sending sound waves directly into the water to be heard by the divers within close proximity.

There are many different manufacturers of diving equipment giving the diver a wide range of choices as to which mask, regulator, communication system, and other equipment to use. Consequently, there is a wide range of combinations of diving equipment which may be used.

One problem that currently exists with conventional diving equipment is that underwater breathing creates air bubbles and attendant noise which may interfere with a diver's vision and communication ability. Most air bubbles are exhausted as the diver exhales through the housing of the regulator mouthpiece. Once exhausted from the mouthpiece, these bubbles may travel up and in front and around the divers face, ending up in front of the diver's eyes and ears, and generally obstructing the diver's vision and communication abilities including the diver's ability to hear.

This is especially true when a diver is positioned with the top of his head towards the surface of the water, and looking forward or up, as the bubbles generally ascend upward along the diver's face. Consequently, divers have come to accept bubbles as part of the diving experience. To avoid bubbles, some divers may try to position themselves with their head positioned downward or hold their breath when trying to hear. Apart from being an inconvenience, this may not always be possible especially when the diver ascends and has to look up to ensure that he does not collide with something above him.

SUMMARY OF THE INVENTION

This invention provides a Scuba diving bubble diverter for divetering bubbles from the diver's face and line of vision. According to one embodiment, bubbles are also diverted away from the diver's ears and temple areas, improving the diver's ability to communicate. According to a preferred embodiment, the diverter of this invention includes a lower skirt-like portion or section and an upper portion or section comprising fluid conduits or channeling means for providing bubble capture/flow and diversion channels.

In one form the diverter may be easily attached to or associated with almost any Scuba diving mask including some full face masks and will contain the exhausting bubbles that come out of the breathing regulator clinched in the divers mouth and divert these exhausting bubbles behind and away from the divers mask, line of vision, and ears. The diverter may further help keep the bubbles away, not allowing them to touch and travel along, from at least the top part of the divers head, including the ears and temple areas of the head, thereby reducing some of the bubble noise to the diver as well as improving his vision.

The diverter may have a built-in weight system that controls and maintains the correct placement and shape of the skirt. Additionally, the diverter may be made from a thin flexible air impermeable material which may be waterproof, including cloth, neoprene, rubber urethane, or silicone. The diverter may alternately be made from rigid and/or semi rigid materials, or a combination of flexible, rigid, and/ or semi-rigid materials.

OBJECTS OF THE INVENTION

It is an object of the present invention to provide a Scuba diving bubble diverter for diverting bubbles away from the diver's face, including the diver's line of vision.

It is a further object of the present invention to provide a Scuba diving bubble diverter for diverting bubbles away from the diver's ears-and temple areas, for reducing some of the bubble noise to the diver and improving the diver's ability to communicate.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
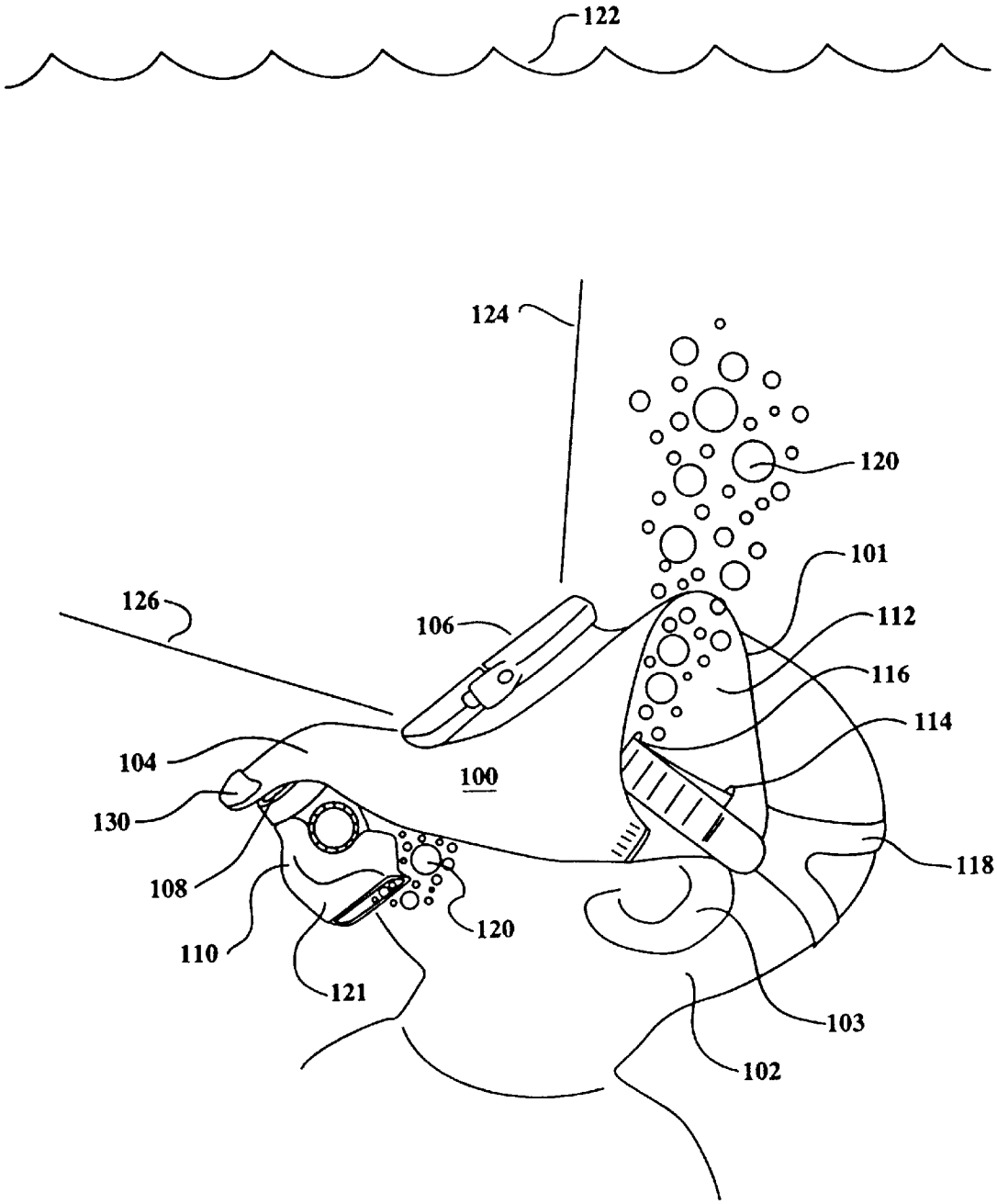
FIG. 1 is a left side elevational view of a Scuba diving bubble diverter worn by a diver positioned face up along with a conventional diving mask and regulator, in accordance with one embodiment of the present invention.
Figure 2:
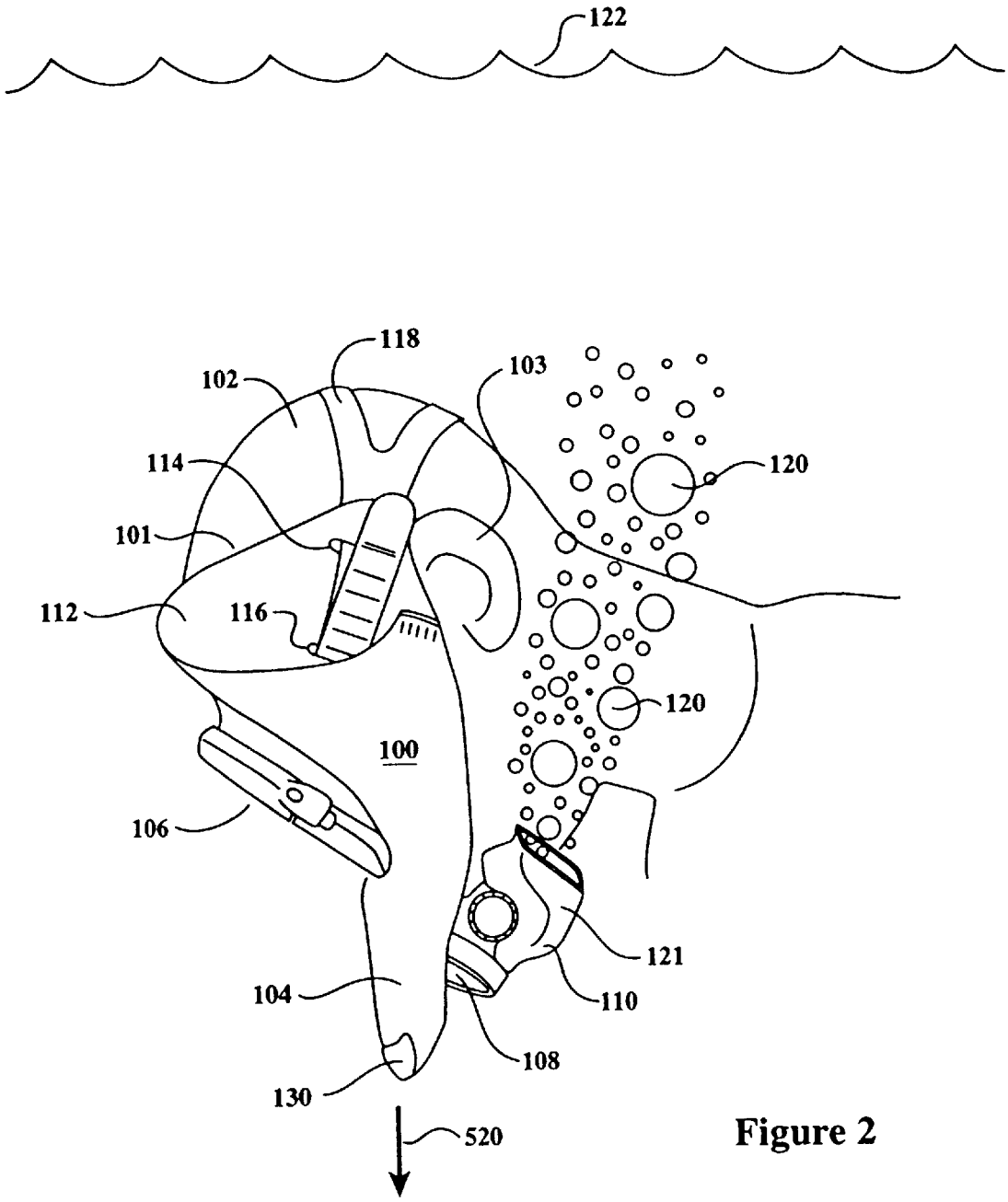
FIG. 2 is a view similar to FIG. 1, showing the diver in a face down position.
Figure 3:
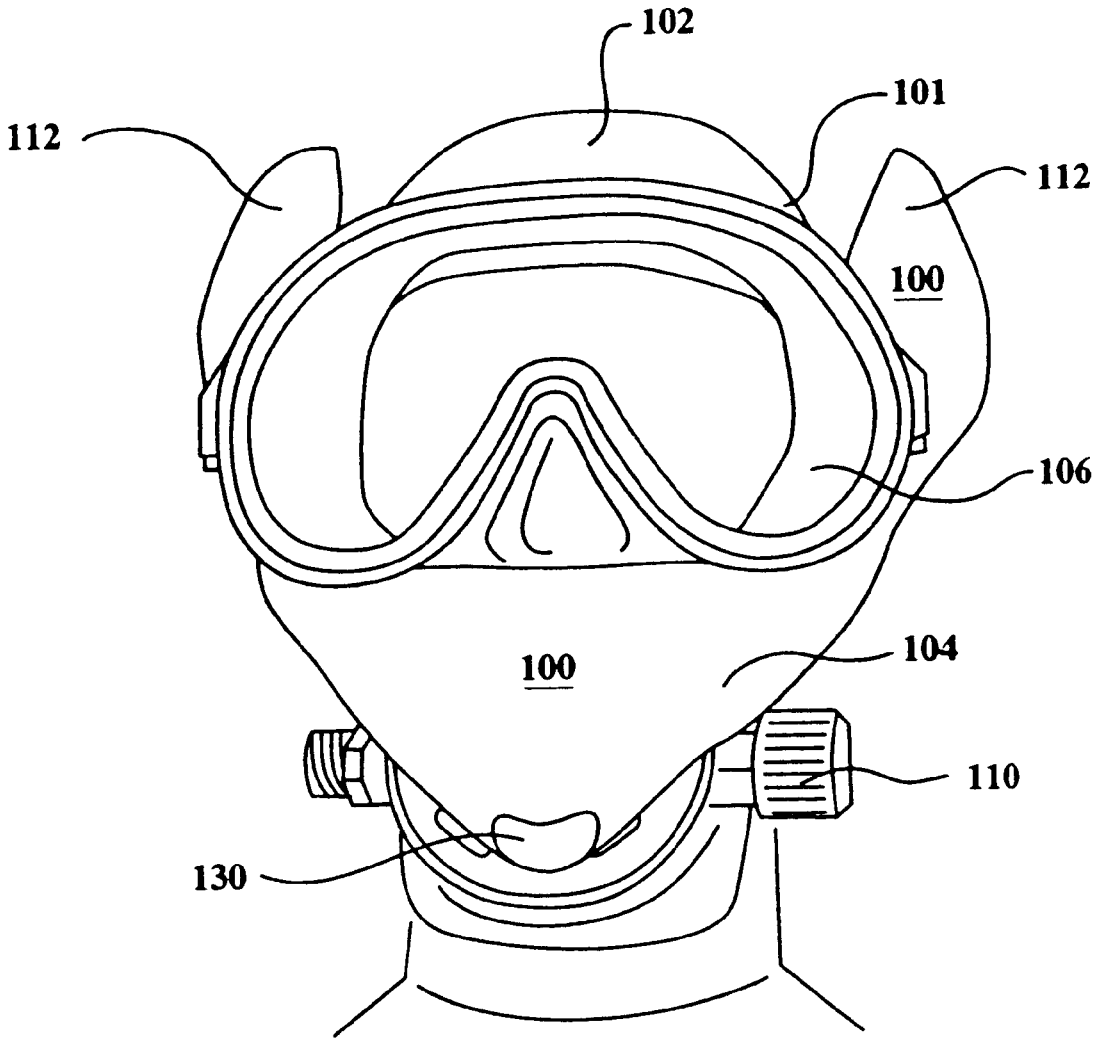
FIG. 3 is a front elevational view of the diverter of FIG. 1.

Referring to the drawings wherein like numeral of reference designate like elements throughout, FIGS. 1–5 illustrate a Scuba diving bubble diverter 100 according to one embodiment of the present invention. The diverter 100 is shown in FIGS. 1–4 as worn by a diver 102 having upper head or temple portions 101 and ears 103. The diverter 100 comprises a lower skirt-like portion or section 104 which extends below a conventional diving mask 106 and over the purge area 108 of a conventional regulator 110, when the regulator is held in the diver's mouth, as shown in FIGS. 1–3, diverter 100 has upper rearwardly configured sections forming fluid conduits or channeling means 112 adjacent to the sides of the mask 106 generally between the diver's ears 103 and eyes (not shown) for channeling bubbles 120 and attendant noise away from the front of the mask 106 and ultimately diver 102. The fluid conduits 112 preferably further steer or divert the bubbles away from the diver's ears 103, and form a barrier along the sides of the diver's face, such that the bubbles 120 are substantially prevented from contacting the diver's cheek, ear, and temple areas. The fluid conduits or channeling means 112 may assume a tubular, semi-tubular, conically tubular, or any other suitable shape, preferably conforming against the sides of the mask and face, but directed upwardly and rearwardly as shown in the figures. The fluid conduits or channeling means 112 may vary in length, size, and shape.

According to a preferred embodiment, the diverter 100 can be attached to most any Scuba diving mask. The diverter 100 has slits or appertures 114, 116, such that it can be conveniently attached via strap 118 of mask 106 by inserting the strap through the apertures or slits 114, 116. However, any method of attaching the diverter 100 to the mask 106 or otherwise positioning the diverter 100 is contemplated. For example, clips, Velcro, buttons, zippers, or glue may be used to attach the diverter 100 to the mask 106, or the diverter 100 may have its own straps for placing around the head of the diver. Additionally, a diving mask may be designed with a customized or integral diverter as an integral part of the mask itself, or as an attachable/ detachable accessory as those of ordinary skill in the art will recognize.

As shown in FIGS. 1 and 2, bubbles 120 expelled through the regulator whisker 121 generally travel upward towards the surface of the water 122. Thus, when the diver is facing forward or facing up, as shown in FIG. 1, the bubbles 120 tend to travel in front of the diver's mask 106 and line of vision (schematically indicated by the lines 124, 126 in FIG. 1). The diverter 100 provides a bubble capture/flow system for channeling and diverting bubbles and attendant noise away from the front area of the mask 106. Thus the bubbles 120 are diverted, generally, according to the fluid flow path indicated by the arrows 500 in FIG. 5, away from the diver's line of vision. The diverter 100 further helps keep the bubbles 120 from traveling along and making contact with the top portion of the diver's head, including the ears 103, cheeks, and temple areas 101, reducing some of the bubble noise to the diver.

The diverter is preferably made from a flexible material which may be thin, air tight or air impermeable and/or waterproof. Suitable flexible materials include neoprene, rubber, silicone, or urethane of suitable thickness, as those of ordering skill in the art will recognize. The material may also be transparent so as to not obstruct the diver's vision in case the skirt portion 104 moves up and in front of the diver's mask. Suitable materials which may be both flexible and transparent include, but are not limited to silicone, and urethane.

Figure 6:
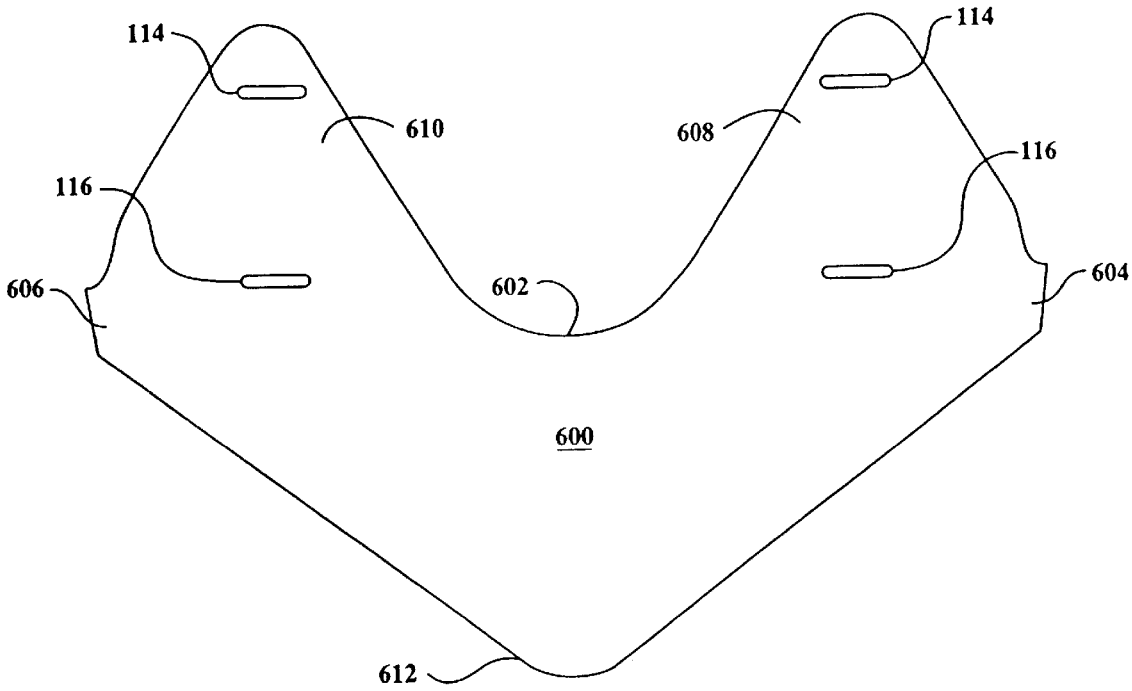
FIG. 6 illustrates a flat pattern for the diverter of FIG. 1.

FIG. 6 shows a suitable flat pattern 600 for forming the diverter 100 from a flexible material. However, it should be noted that there are many possible patterns for forming a diverter according to the present invention.

Figure 5:
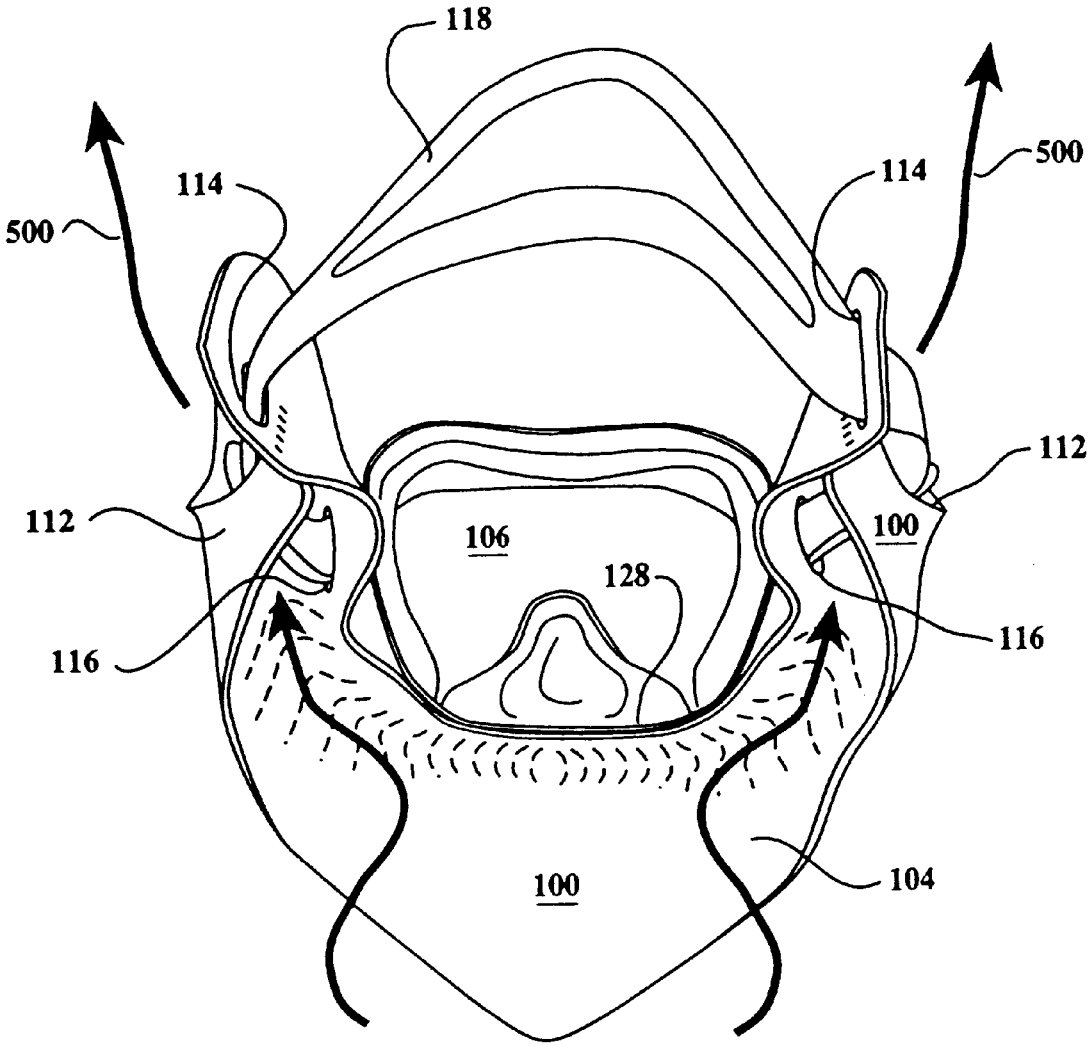
FIG. 5 is a backside elevation view of the diverter of FIG. 1, but shown without the diver.

In this instance, the pattern has an inner edge 602 having a contour designed to substantially conform to the lower seal part 128 of the mask 106 and face of the diver. The inner edge 602 of the pattern 600 forming the diverter 100 may fold inwardly in an overlaying alignment with the lower seal part 128 of the mask 106, as shown in FIG. 5.

The diverter 100 is formed from the pattern 600 by stitching, gluing, molding, adhering, or otherwise attaching the outer flaps 604, 606 to suitable inner sections 608 and 610 respectively to form the conduits 112 of the diverter 100. Additionally, the lower edge 612 of the skirt may be generally U-shaped and/or somewhat pointed for hanging over the regulator 110.

Figure 4:
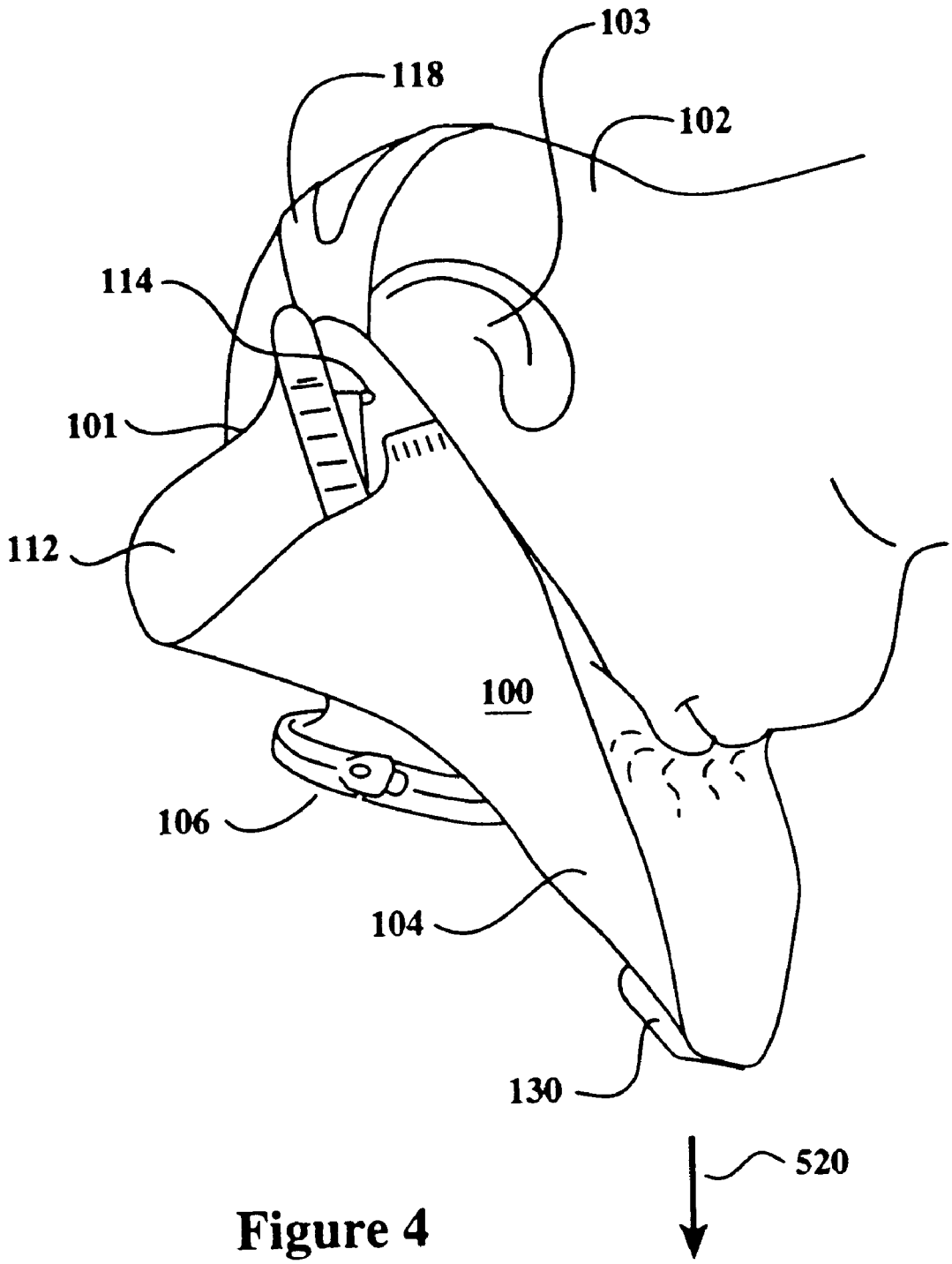
FIG. 4 is a left side perspective view of the diverter of FIG. 1, worn by a diver along with a conventional diving bubble diverter but shown without a regulator for purposes of illustrating the diver having full access to the mouth and chin area of the face while in the face down position.

According to a preferred embodiment, the diverter 100 may have a small amount of weight (or weights) attached at a lower end or edge of the skirt 104 for controlling and maintaining the positioning of the skirt. A pocket 130 may be formed within the skirt containing the weights. The weight serves to hold the skirt in the correct position, such that it hangs over the regulator, when buoyancy and/or exhausted bubbles would otherwise force the skirt upwards and in front of the diver's face, especially when the diver is in the facing forward or facing up positions, since the bubbles tend to travel upwards as shown by the arrows 500. Furthermore, when the diver is positioned face down, as shown in FIGS. 2 and 4, the weight holds the skirt down, as indicated by arrows 520, and away from the diver's mouth and face giving the diver full access to his mouth and chin area as shown in FIG. 4.

Use of thin flexible materials, as described above, allows the diverter 100 to conform to and around many types and shapes of masks, faces and breathing regulators. Additionally, use of such thin and flexible materials allows the diver to push through the diverter to the regulator purge button or regulator purge area, giving the diver access to operate the regulator purge system without having to move the skirt.

The diverter 100 may also be molded or otherwise formed from rigid and/or semi rigid materials. Additionally, the diverter can be formed from a combination of different materials. For example the skirt section of the diverter may be formed from a flexible material while the upper part of the diverter is formed from a rigid material. Alternatively, the entire diverter may be formed from a rigid material while incorporating regions or "windows" of a flexible material which would allow the diver to push through the diverter in order to access the purge button or regulator purge area. Furthermore, the diverter may be made of a flexible material but have a rigid or semi-rigid frame or border for maintaining its positioning and shape, without use of a weight.

Figure 7:
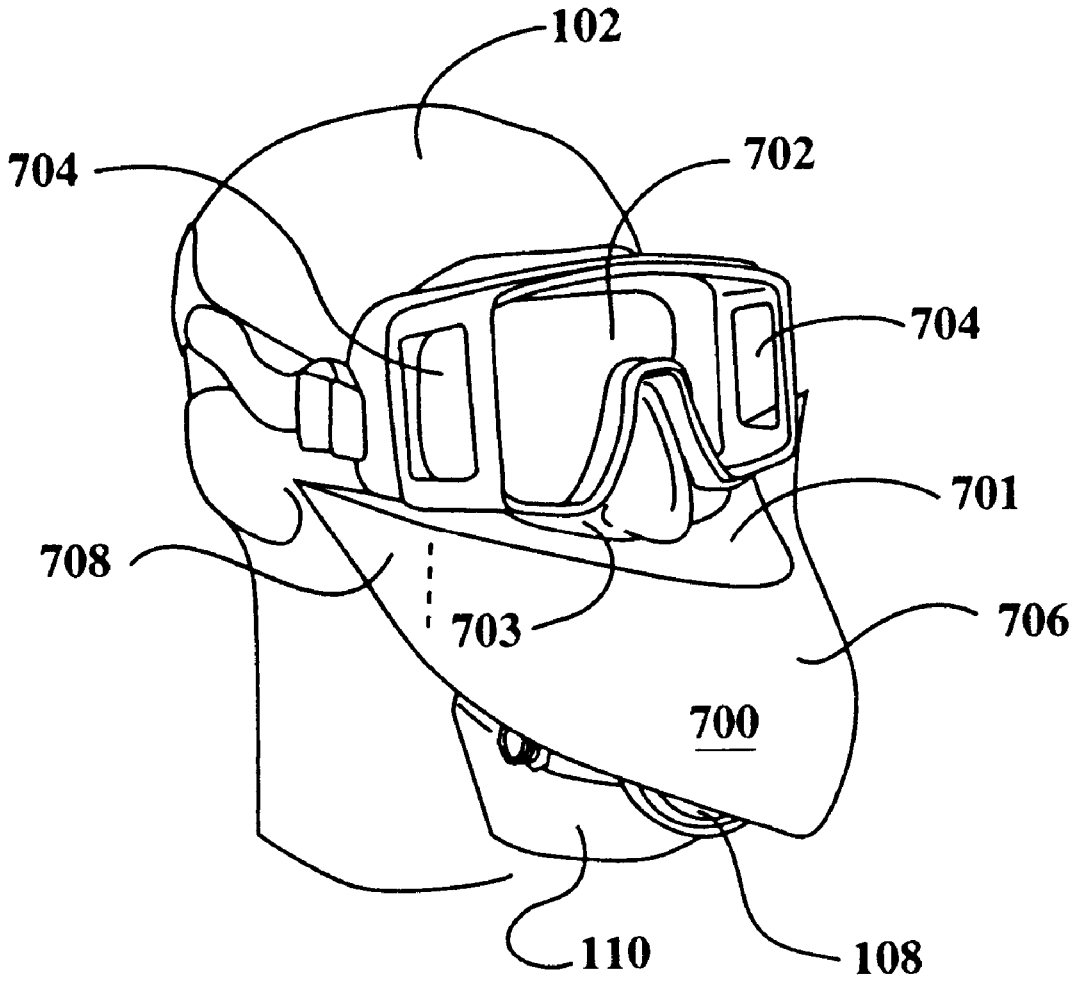
FIG. 7 is a right side perspective view of a Scuba diving bubble worn by a diver positioned face up along with a conventional diving mask having side windows and regulator, in accordance with another embodiment of the present invention.
Figure 8:
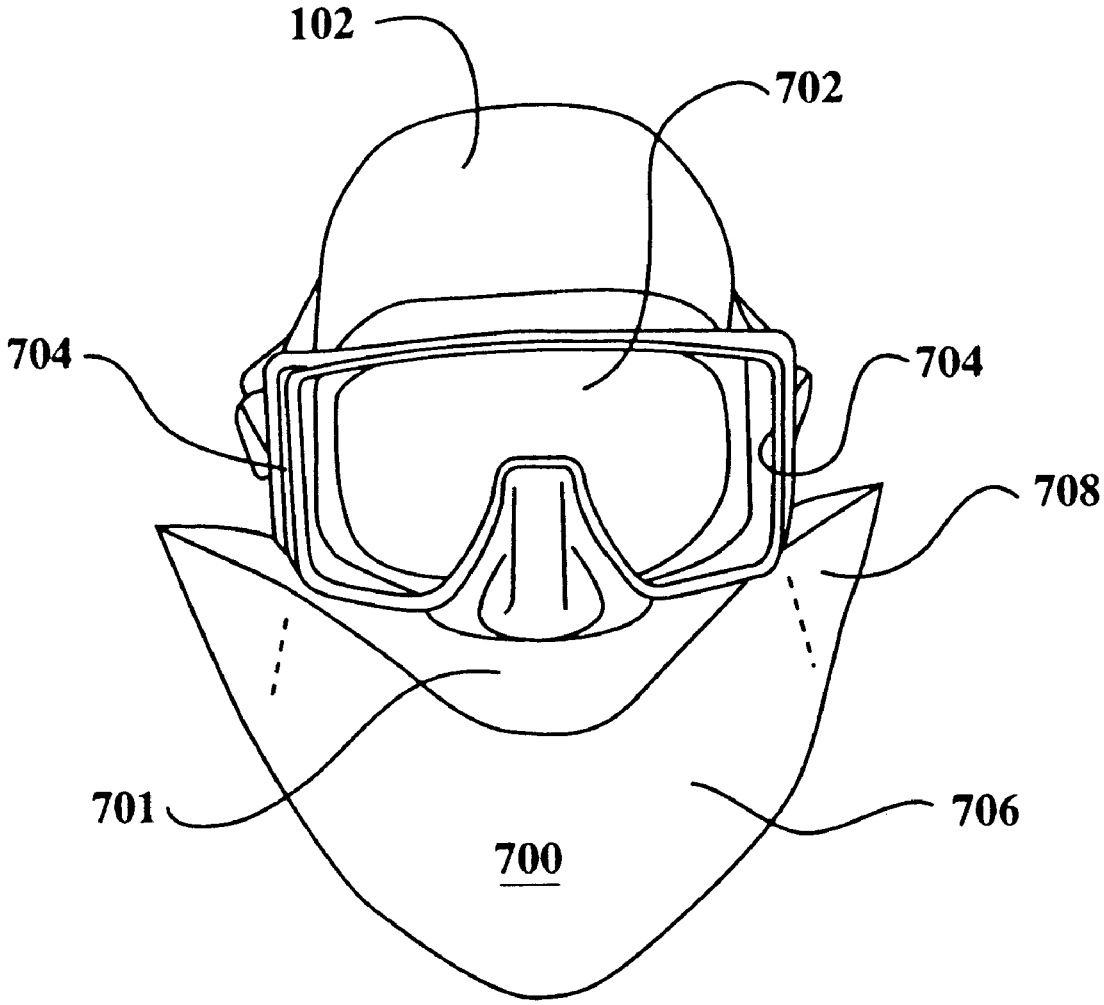
FIG. 8 is a front elevational view of the diverter of FIG. 7.
Figure 9:
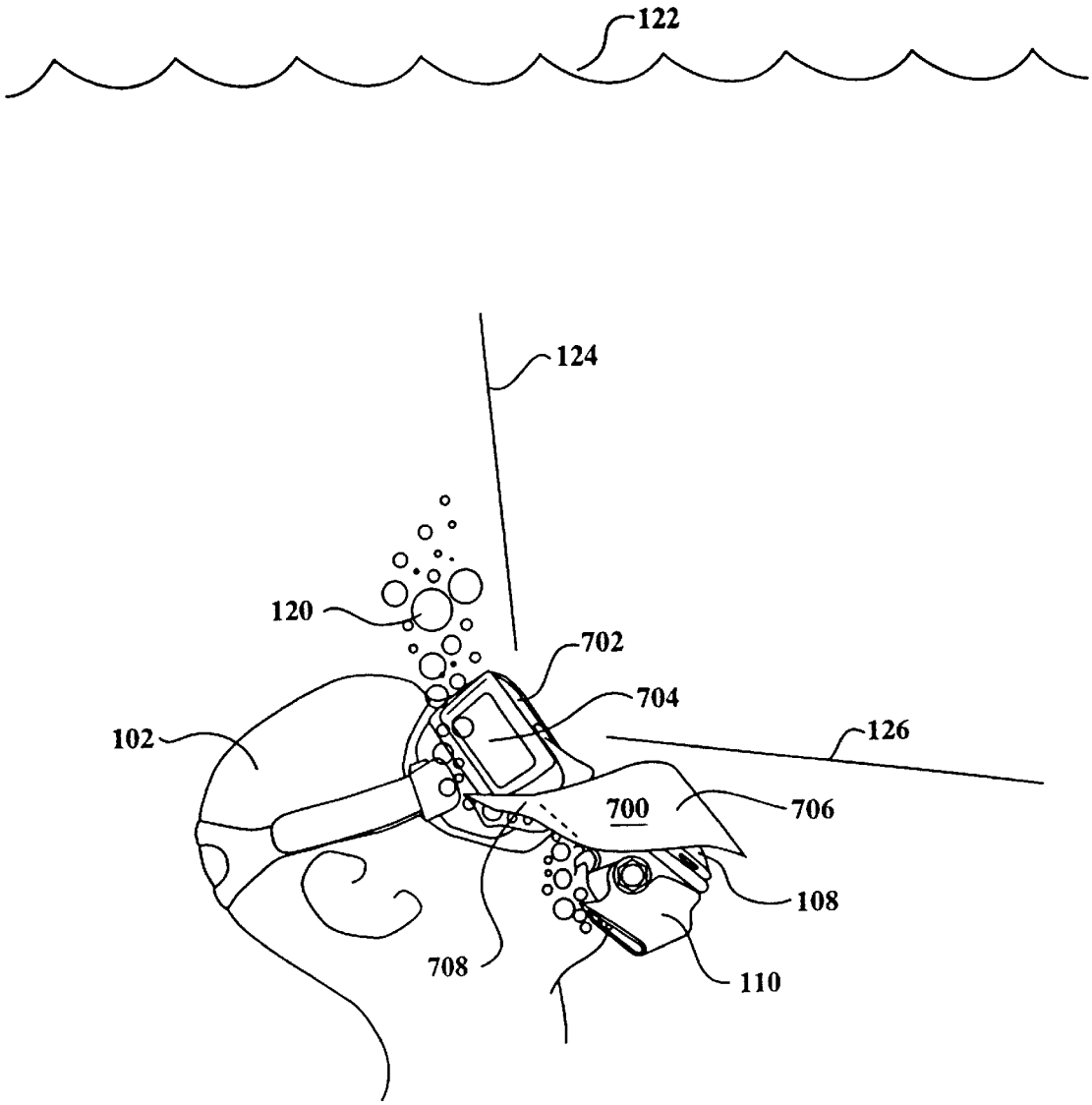
FIG. 9 is a side elevational view of the diverted of FIG. 7.

FIGS. 7–9 illustrate a diverter 700 according to another embodiment of the present invention. The diverter 700 is shown in FIGS. 7–9 as worn by the diver 102 along with a conventional diving mask 702, which includes side windows

704. The diverter 700 is preferably made from a rigid material and comprises a flat portion 701 extending outwardly from the lower seal part 703 of the mask 702, preferably conforming against the seal part 703. A lower skirt-like portion or section 706 extends downwardly from the flat portion 701, below the mask 702 and over the purge area 108 of the regulator 110 when the regulator is held in the diver's mouth, as shown in the figures.

The diverter 700 has rearwardly configured sections forming fluid conduits or channeling means 708 positioned away from the side windows 704 of the mask 702. Unlike the conduits or channeling means 112 of the diverter 100 which are adjacent to the sides of the mask 106, the conduits or channeling means 708 of the diverter 700 are preferably positioned so as to not block the diver's side vision made available to the diver by use of a diving mask having side windows. As shown in FIGS. 7–9, the conduits or channeling means 708 are formed below the windows 704, and are configured rearwardly, more so then the conduits or channeling means 112 of the diverter 100, so as to disperse the bubbles away from the diver's line of vision, as illustrated in FIG. 9. The conduits or channeling means 708 may assume any suitable shape, and may extend further upwardly and/or rearwardly, as long as the diver's side view remains substantially unblocked.

The diverter 700 may be attachable to the mask 702 by attachment of the flat portion 701 to the seal 703 via any suitable method including clips, Velcro, buttons zippers, or glue. Additionally, a diving mask having side windows may be designed with a customized or integral diverter as an integral part of the mask itself, or as an attachable/ detachable accessory as those of ordinary skill in the art will recognize.

Though preferably rigid, the diverter may also include flexible material, for example, for forming part or all of the skirt 706 and/or conduits 708 or channeling means 708.

While the present invention has been described with regards to particular embodiments, it is recognized that additional variations of the present invention may be devised without departing from the inventive concept.

What is claimed is:

1. A Scuba diving bubble diverter adapted for use by a diver wearing a diving mask having a strap and regulator comprising:

an upper section including conduits, formed adjacent to the left and right sides of the mask above said skirt, said upper section further including slits formed within said upper section, for attaching the diverter to the mask by inserting the strap of the mask through said slits;

a skirt extending below the mask and over a front portion of the regulator wherein said skirt and conduits channel bubbles exhausted from the regulator away from the front of the mask, such that the bubbles are diverted away from the diver's line of vision.

2. The diverter of claim 1 wherein said conduits are formed to the left and right sides of said skirt.

3. The diverter of claim 2 wherein said conduits are rearwardly configured.

4. The diverter of claim 1 wherein said conduits are adjacent to the left and right sides of the mask, above said skirt.

5. The diverter of claim 1 wherein the mask includes side windows and said conduits are positioned away from said side windows so as to not block the diver's side vision.

6. The diverter of claim 1 further comprising a flat portion extending outwardly from the lower seal of the mask wherein said skirt extends downwardly from said flat portion.

7. The diverter of claim 1 wherein said conduits channel bubbles exhausted from the regulator, away from the diver's ears.

8. The diverter of claim 1 wherein said conduits form a barrier along the sides of the diver's face, for substantially preventing bubbles exhausted from the regulator from contacting the diver's cheek, ears, and temple.

9. The diverter of claim 1 wherein said skirt and conduits are made from a flexible material.

10. The diverter of claim 1 wherein said skirt and conduits are made from a material selected from the group consisting of neoprene, rubber, silicone, urethane, and a combination thereof.

11. The diverter of claim 1, said skirt further comprising an attached weight for decreasing its buoyancy, and maintaining its proper positioning.

12. The diverter of claim 1, wherein said skirt further extends around the sides of the regulator.

13. A Scuba diving bubble diverter adapted for use by a diver wearing a diving mask and regulator comprising:

A skirt extending below the mask and over a front portion of the regulator, said skirt including a thin flexible material forming a section of the skirt corresponding to a purge area of the regulator, for enabling the diver to control the regulator purge system by pushing through the skirts, said skirt further comprising conduits wherein said skirt and conduits channel bubbles exhausted from the regulator away from the front of the mask, such that the bubbles are diverted away from the diver's line of vision, said skirt and conduits being made of a flexible material.

* * * * *